US008985090B2

(12) United States Patent
Bolz et al.

(10) Patent No.: US 8,985,090 B2
(45) Date of Patent: Mar. 24, 2015

(54) METHOD FOR OPERATING AN IGNITION DEVICE FOR AN INTERNAL COMBUSTION ENGINE, AND IGNITION DEVICE FOR AN INTERNAL COMBUSTION ENGINE FOR CARRYING OUT THE METHOD

(75) Inventors: Stephan Bolz, Pfatter (DE); Sven Eisen, Bad Abbach (DE); Martin Götzenberger, Ingolstadt (DE); Achim Reuther, Donaustauf (DE); Harald Schmauβ, Donaustauf (DE)

(73) Assignee: Continental Automotive GmbH, Hannover (DE)

( * ) Notice: Subject to any disclaimer, the term of this patent is extended or adjusted under 35 U.S.C. 154(b) by 474 days.

(21) Appl. No.: 13/515,190

(22) PCT Filed: Dec. 8, 2010

(86) PCT No.: PCT/EP2010/069221

§ 371 (c)(1),
(2), (4) Date: Aug. 30, 2012

(87) PCT Pub. No.: WO2011/070089

PCT Pub. Date: Jun. 16, 2011

(65) Prior Publication Data

US 2012/0312285 A1 Dec. 13, 2012

(30) Foreign Application Priority Data

Dec. 11, 2009 (DE) ..... 10 2009 057 925

(51) Int. Cl.
*F02P 3/05* (2006.01)
*F02P 3/04* (2006.01)
(Continued)

(52) U.S. Cl.
CPC ..... *F02P 3/0442* (2013.01); *F02P 15/08* (2013.01); *F02D 2041/2003* (2013.01); *F02D 2041/2058* (2013.01)
USPC ..... 123/623; 123/618

(58) Field of Classification Search
CPC .. F02D 2041/2058; F02D 37/02; F02P 1/083; F02P 5/045; F02P 15/10; F02P 17/12
USPC ..... 123/618, 620, 623, 627, 644, 651, 123/406.11, 406.12, 406.19, 123/406.26–406.28, 406.33
See application file for complete search history.

(56) References Cited

U.S. PATENT DOCUMENTS 5,558,071 A * 9/1996 Ward et al. ..... 123/598
5,758,629 A 6/1998 Bahr et al. ..... 123/644
(Continued)

FOREIGN PATENT DOCUMENTS

AT 409406 B 8/2002 ..... F02P 3/045
DE 19614287 C1 6/1997 ..... F02P 3/04
(Continued)

OTHER PUBLICATIONS

PCT/EP2010/069221 Written Opinion English Translation.*
(Continued)

*Primary Examiner* — John Kwon
*Assistant Examiner* — Johnny H Hoang
(74) *Attorney, Agent, or Firm* — King & Spalding L.L.P.

(57) ABSTRACT

A method is provided for operating an ignition device for an internal combustion engine, which ignition device includes an ignition coil configured as a transformer, a spark plug connected to the secondary winding of the ignition coil, an actuable switching element connected in series to the primary winding of the ignition coil, and a control unit connected to the control input of the switching element, wherein the control unit provides an adjustable supply voltage for the ignition coil and an actuating signal for the switching element as a function of the currents through the primary and the secondary windings of the ignition coil and the voltage between the connecting point of the primary winding of the ignition coil to the switching element and the negative terminal of the supply voltage, as a result of which firstly operation of the spark plug by way of alternating current is possible and secondly regulation of said current is possible, which leads to more reliable ignition with a lower wear of the spark plugs.

6 Claims, 3 Drawing Sheets

(51) Int. Cl.
*F02P 15/08* (2006.01)
*F02D 41/20* (2006.01)

(56) References Cited

U.S. PATENT DOCUMENTS

| | | | | |
|---|---|---|---|---|
| 5,801,534 | A * | 9/1998 | Hohner et al. | 324/399 |
| 5,947,093 | A * | 9/1999 | Ward | 123/598 |
| 6,729,317 | B2 | 5/2004 | Kraus | 123/606 |
| 6,823,841 | B2 | 11/2004 | Schmolla | 123/406.12 |
| 7,392,798 | B2 | 7/2008 | Wada et al. | 123/620 |
| 7,644,707 | B2 | 1/2010 | Kraus et al. | 123/623 |
| 8,607,770 | B2 * | 12/2013 | Kraus et al. | 123/644 |
| 2002/0134363 | A1 * | 9/2002 | Meinders | 123/620 |
| 2008/0035131 | A1 * | 2/2008 | Kraus et al. | 123/623 |
| 2008/0121214 | A1 | 5/2008 | Bertsch et al. | 123/406.12 |
| 2008/0184977 | A1 | 8/2008 | Lepley | 123/596 |
| 2009/0174978 | A1 * | 7/2009 | Nakamura | 361/90 |

FOREIGN PATENT DOCUMENTS

| | | | | |
|---|---|---|---|---|
| DE | 19608526 | A1 | 9/1997 | F02P 3/04 |
| DE | 10121993 | A1 | 11/2002 | F02P 3/04 |
| DE | 102004056844 | A1 | 6/2006 | F02P 15/08 |
| DE | 102007000052 | A1 | 8/2007 | F02P 15/10 |
| DE | 102008006304 | A1 | 8/2008 | F02P 3/09 |
| DE | 102007034390 | A1 | 1/2009 | F02P 3/05 |
| DE | 102007034399 | A1 | 1/2009 | F02P 3/05 |
| DE | 102009026424 | A1 | 12/2009 | F02P 17/12 |
| EP | 1854997 | A2 | 3/2007 | F02P 3/045 |

OTHER PUBLICATIONS

German Office Action, German Patent Application No. 10 2009 057 925.7-13, 5 pages, Sep. 23, 2010.

International PCT Search Report, PCT/EP2010/069221, 11 pages, Mar. 25, 2011.

* cited by examiner

METHOD FOR OPERATING AN IGNITION DEVICE FOR AN INTERNAL COMBUSTION ENGINE, AND IGNITION DEVICE FOR AN INTERNAL COMBUSTION ENGINE FOR CARRYING OUT THE METHOD

CROSS-REFERENCE TO RELATED APPLICATIONS

This application is a U.S. National Stage application of International Application No. PCT/EP2010/069221 filed Dec. 8, 2010, which designates the United States of America, and claims priority to German Application No. 10 2009 057 925.7 filed Dec. 11, 2009, the contents of which are hereby incorporated by reference in their entirety.

TECHNICAL FIELD

This disclosure is related to a method for operating an ignition device for an internal combustion engine, and an ignition device for carrying out such method.

BACKGROUND

For many decades, series ignition systems in present day internal combustion engines embodied as spark ignition engines have operated according to the simple and reliable principle of coil discharge, that is to say that an ignition coil correspondingly designed as a transformer is charged on the primary side in accordance with its inductance from the on board supply system voltage partly into its saturation region. At the ignition instant, the charging is interrupted by means of an electronic circuit, e.g. by an ignition IGBT (Insulated Gate Bipolar Transistor). On the secondary side, a voltage of e.g. 5 kV to 35 kV thereby builds up, which leads to a sparkover in the spark gap of the spark plug in the combustion chamber of the internal combustion engine. The energy stored in the coil subsequently decreases in the ignition plasma.

In the course of advancing engine development, savings in terms of consumption and emissions have to be realized which in recent years have consistently led to an increasing additional loading on the ignition system and will continue to do so in the future. Examples of this are e.g. charge stratification, in which liquid fuel constituents with high flow velocities impede the spark discharge and constrain numerous instances of new spark formation. Increasing combustion chamber pressures for improving engine efficiency also increase the breakdown resistance in the spark gap and constrain a rise in the breakdown voltage, which also influences spark plug wear. This last will lead, in future generations of highly charged engines, to secondary side voltage rises far beyond 35 kV. Both the increasing breakdown voltages and the flow states becoming more intensive at the spark plug tend to shorten the burning duration of the spark since higher and higher proportions of the energy stored in the coil have to be provided for establishing and maintaining the spark. One very promising trend in the development of new combustion methods is the use of multiple sparks, wherein the coil energy is efficiently transmitted to the mixture at short intervals, which increases the reliability of combustion. In the case of ignition devices currently in use, an ignition coil embodied as a transformer with magnetic storage capability is firstly charged on the primary side from the 12V on board system supply up to a current of approximately 8 A. In this case, a blocking diode fitted on the secondary side prevents undesired spark formation during the charging phase. At the ignition instant, the current flow is interrupted by means of an electronic switch—e.g. an IGBT.

The collapse of the magnetic field of the ignition coil then induces a voltage rise on the primary and secondary sides. Owing to the IGBT semiconductor technology used, the primary voltage is in this case limited to typically 400V. On the secondary side, however, the voltage obtains a significantly higher value, which is initially determined by the turns ratio of the transformer. In the case of a conventional turns ratio of 1:80, this therefore results in a maximum secondary voltage of 32 kV. This voltage is not attained in practice, however, since a voltage breakdown between the electrodes of the spark plug with a subsequent arc already takes place beforehand, whereupon the secondary voltage abruptly falls to the value of the arc burning voltage. Typical values for the breakdown voltage are 5 kV to 35 kV and depend greatly on the electrode spacing, the combustion chamber pressure and the gas temperature. The burning voltage of the arc is in the range of a few kV.

In order to attain the breakdown voltage, firstly the secondary side capacitances—caused by the spark plug and the construction of the secondary winding—have to be charged. For a given breakdown voltage Uz, the following holds true in this case:

$$Ec=Csec*Uz^2/2 \quad \{1\}$$

Ec is the energy required for attaining the breakdown voltage, Csec is the secondarily effective capacitance.

This energy, in the case of the conventional ignition system, is supplied by the main inductance Lh of the ignition transformer, which has been correspondingly charged beforehand.

$$El=Lh*I^2/2 \quad \{2\}$$

El is the stored energy
Lh is the main inductance of the transformer
I is the charging current In the case of conventional ignition coils embodied as ignition transformers, the maximum stored energy is 50 mJ to 130 mJ. The residual energy available after breakdown is converted in the subsequent arc phase in the arc, the secondary current falling continuously. The burning duration of the arc of typically 0.5 ms to 1.5 ms is substantially determined by this residual energy.

The requirement for a longer burning duration—and thus increased ignition energy—in difficult combustion situations can be met by increasing the maximum stored energy. However, this necessitates enlarging the magnetic core, which leads to an undesirable enlargement of the ignition coil. Particularly in the case of so-called "pencil coils", incorporated directly in the spark plug shaft, enlargement is not possible. A further disadvantage of simply increasing the ignition energy is the more than proportional spark plug wear associated therewith, for which reason the desired lifetime can no longer be achieved. Present day ignition systems have in some instances already reached this limit, and so simply increasing the ignition energy is not a technically expedient approach.

It has been found, however, that operating the spark plug with alternating current makes possible a lifetime two to three times longer. AC voltage ignition systems have accordingly been developed for motor vehicles. In this case, the ignition coil is embodied as a pure transformer with only low storage capability. In the case of technically expedient turns ratios of e.g. 1:100, a primary voltage of 200V is required in order to attain a breakdown voltage of e.g. 20 kV, which in turn necessitates a complex and expensive voltage converter. The high transformation ratio—from 12V on board supply system voltage to 200V ignition supply—also reduces the efficiency of the voltage converter, which in turn reduces the total efficiency of the ignition system.

Although the use of such AC voltage ignition can solve the engineering problem appertaining to combustion, for cost reasons it is only suitable for top of the range vehicles. Therefore, hitherto it has been necessary to accept the spark plug wear associated with increasing spark energy or combustion critical operating states have not been able to be realized on the series engine.

SUMMARY

In one embodiment, a method is provided for operating an ignition device for an internal combustion engine, which is formed with an ignition coil (ZS) embodied as a transformer, a spark plug (ZK) connected to the secondary winding of the ignition coil (ZS), a drivable switching element (IGBT) connected in series with the primary winding of the ignition coil (ZS), and a control unit (SE) connected to the primary winding of the ignition coil (ZS) and the control input of the switching element (IGBT), wherein the control unit (SE) provides an adjustable supply voltage (Vsupply) for the ignition coil (ZS) and a drive signal (IGBT_Control) for the switching element (IGBT) depending on the currents (I_Prim, I_Sec) through the primary and secondary windings of the ignition coil (ZS) and the voltage between the connecting point of the primary winding of the ignition coil (ZS) to the switching element (IGBT) and the negative terminal of the supply voltage (GND), wherein the method comprises the following sequence:

in a first phase (charging), the switching element (IGBT) is switched by the drive signal (IGBT_Control) to be conducting at a first switch on instant (t1) and to be non conducting again at the predefined ignition instant (t2), in a subsequent second phase (breakdown), the primary voltage or a voltage (V_prim) derived therefrom is compared with a first threshold value (V1) and, in the case of said voltage (V_prim) falling below the first threshold value (V1), the switching element (IGBT) is switched to be conducting again at a second switch on instant (t3), in a subsequent third phase (arc), the supply voltage (Vsupply) is regulated in such a way that the current (I_sec) through the secondary winding of the ignition coil (ZS) approximately corresponds to a predefined current (V2) and the current (I_prim) through the primary winding of the ignition coil (ZS) is compared with a predefined second threshold value (V3) and, in the case of said current (I_prim) exceeding the second threshold value (V3), the switching element (IGBT) is switched to be non conducting again at a first switch off instant (t4), in a subsequent fourth phase (breakdown), the current (I_sec) through the secondary winding of the ignition coil (ZS) is compared with a third threshold value (V4) and, in the case of said current (I_sec) falling below the third threshold value (V4), the switching element (IGBT) is switched to be conducting again at a third switch on instant (t5), and subsequently the third and fourth phases are repeated, if appropriate, until a predefined burning duration is reached at an instant (t6), at which the switching element (IGBT) is finally switched to be non conducting.

In a further embodiment, the supply voltage (Vsupply) is set to its maximum value with the switching element (IGBT) being switched to be non conducting. In a further embodiment, the current (V2) predefined in the third phase is variable, more particularly rising. In a further embodiment, during the phases (arc) in which the switching element (IGBT) is switched to be conducting, the current (I_sec) through the secondary winding is compared with a fourth threshold value (V5) and the switching element (IGBT) is switched to be non conducting if the fourth threshold value (V5) is exceeded by said current, and in that afterward the primary voltage or a voltage (V_prim) derived therefrom is compared with the first threshold value (V1) and, in the case of said voltage (V_prim) falling below the first threshold value, the switching element is switched to be conducting again.

In another embodiment, an ignition device for an internal combustion engine is provided, which is formed with an ignition coil (ZS) embodied as a transformer, the secondary winding of which ignition coil is designed for connection to a spark plug (ZK), a drivable switching element (IGBT) connected in series with the primary winding of the ignition coil (ZS), and a control unit (SE) connected to the primary winding of the ignition coil (ZS) and the control input of the switching element (IGBT), wherein the control unit (SE) for carrying out any of the methods disclosed above is formed with a controllable voltage converter (DC/DC), which provides at its output (Vout) a supply voltage (Vsupply) for the ignition coil (ZS), said supply voltage being adjustable depending on a control signal (V_Control) present at the control input (Ctrl) of said voltage converter, and can be connected to a motor vehicle on board supply system voltage (V_bat), and wherein the control unit (SE) is formed with a control circuit (Control), which provides the control signal (V_Control) for the voltage converter (DC/DC) and a drive signal (IGBT_Control) for the switching element (IGBT) depending on the currents through the primary and secondary windings of the ignition coil (ZS) and the voltage between the connecting point of the primary winding to the switching element (IGBT) and the negative terminal (GND) of the supply voltage (Vsupply).

In a further embodiment, the control circuit (Control) has voltage comparators (Comp1, . . . Comp4), to the reference inputs of which reference signals (V1, V3, V4, V5) can be applied and to the comparison inputs of which can be applied signals representing the current through the primary winding of the ignition coil and the current through the secondary winding of the ignition coil and the voltage (V_Prim) derived from the voltage between the connecting point of the primary winding to the switching element (IGBT) and the negative terminal (GND) of the supply voltage (Vsupply) and the outputs of which are connected to inputs of a sequence controller (ALS), the first output of which is connected to the control input of the switching element (IGBT) and the second output of which is connected, via a switching means (SM) that can be changed over by the sequence controller (ALS), to the control input (Ctrl) of the voltage converter (DC/DC), and in that the control circuit (Control) has a regulator circuit (Regulator1), to the reference input of which a reference signal (V5) representing a desired value can be applied and to the comparison input of which the signal representing the current through the secondary winding of the ignition coil (I_sec) can be applied and the output of which is connected, via the switching means (SM) that can be changed over, to the control input (Ctrl) of the voltage converter (DC/DC).

BRIEF DESCRIPTION OF THE DRAWINGS

Example embodiments will be explained in more detail below with reference to figures, in which.

DETAILED DESCRIPTION

Figure 1:
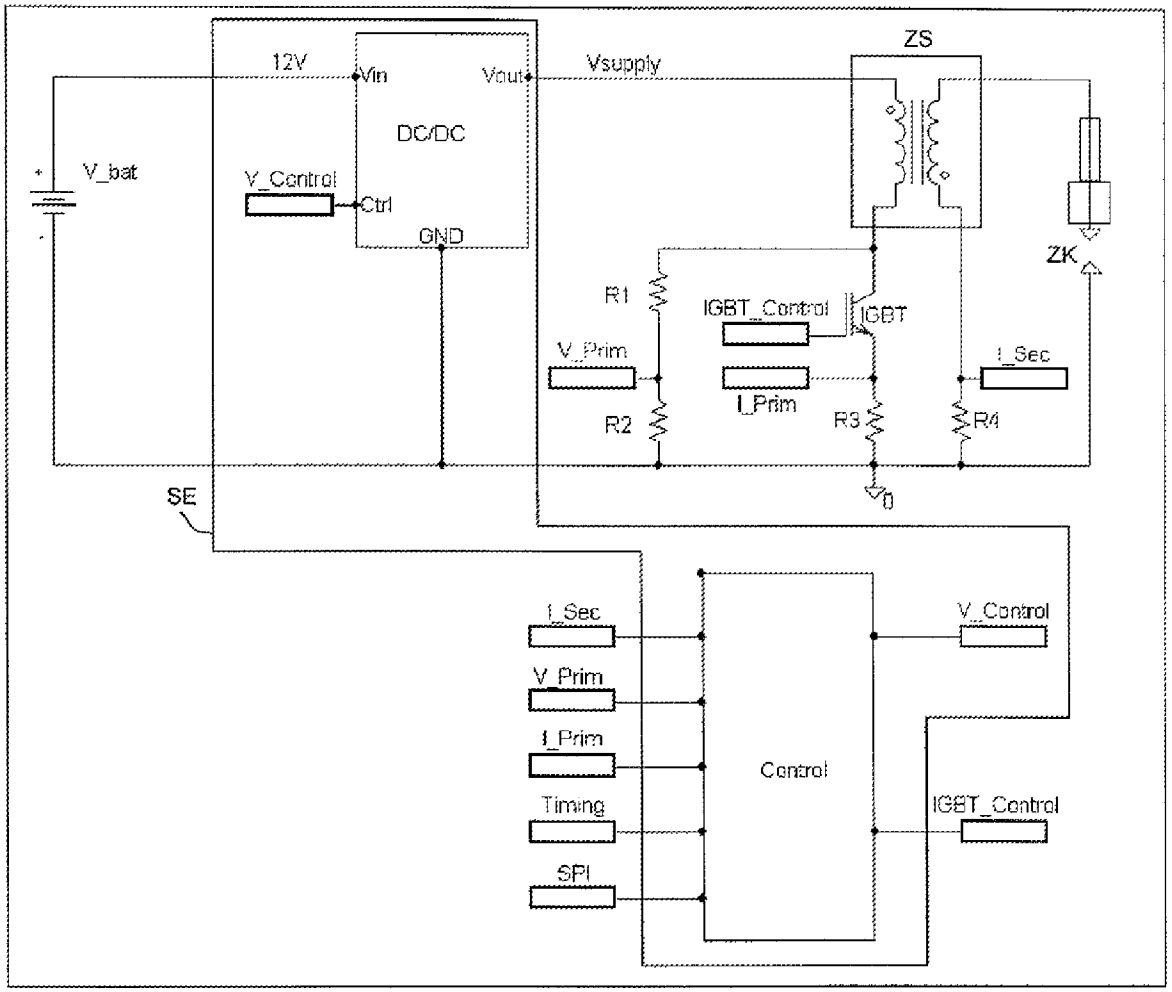
FIG. 1 shows a block diagram of an ignition device, according to one embodiment.

Some embodiments may improve ignition behavior in conjunction with a significantly increased lifetime of a spark plug. Moreover, the components of a conventional ignition system may be utilized as far as possible without additional outlay.

The object is achieved, according to patent claim 1, by means of a method for operating an ignition device for an internal combustion engine, which is formed with an ignition coil embodied as a transformer, a spark plug connected to the secondary winding of the ignition coil, a drivable switching element connected in series with the primary winding of the ignition coil, and a control unit connected to the primary winding of the ignition coil and the control input of the switching element. According to some embodiments, the control unit provides an adjustable supply voltage for the ignition coil and a drive signal for the switching element depending on the currents through the primary and secondary windings of the ignition coil and the voltage between the connecting point of the primary winding of the ignition coil to the switching element and the negative terminal of the supply voltage. The method in this case has the following sequence: in a first phase (charging), the switching element is switched by the drive signal to be conducting at a first switch on instant and to be nonconducting again at the predefined ignition instant, in a subsequent second phase (breakdown), the primary voltage or a voltage derived therefrom is compared with a first threshold value and, in the case of said voltage falling below the first threshold value, the switching element is switched to be conducting again at a second switch on instant, in a subsequent third phase (arc), the supply voltage is regulated in such a way that the current through the secondary winding of the ignition coil approximately corresponds to a predefined current and the current through the primary winding of the ignition coil is compared with a predefined second threshold value and, in the case of said current exceeding the second threshold value, the switching element is switched to be non conducting again at a first switch off instant, in a subsequent fourth phase (breakdown), the current through the secondary winding of the ignition coil is compared with a third threshold value and, in the case of said current falling below the third threshold value, the switching element is switched to be conducting again at a third switch on instant, subsequently the third and fourth phases are repeated, if appropriate, until a predefined burning duration is reached at an instant, at which the switching element is finally switched to be non conducting.

In some embodiments, use is made of the insight that spark plug wear in the case of the conventional ignition system is very significantly influenced by the magnitude of the maximum current value during the burning phase of the arc. For the same root mean square value, an approximately constant direct current causes significantly less wear than the conventional triangular waveform secondary current having a high peak value. If, during the burning phase, the polarity of the current flow is reversed once or repeatedly, then the wear is reduced further.

Some embodiments provide methods and ignition devices having any of the following special features:

The ignition coil embodied as a transformer is operated conventionally until the first breakdown of the spark. After the breakdown, the ignition spark is substantially fed by the primary side of the transformer. In this case, a variable supply voltage is used in such a fashion that the secondary side current has a desired temporal profile. The main inductance is recharged in order to be able to rapidly effect ignition anew when the spark is extinguished. On account of the operation of the transformer with a variable supply voltage, premature spark formation (switch on spark) is avoided. The charge state of the transformer can be set during the burning duration. A decoupling of charging time and charging energy can be produced by virtue of the supply voltage being regulated to constant current when the desired current is attained. It is possible to use a cost optimized ignition coil (transformer) which can produce only the voltage/energy necessary for the breakdown. An AC voltage operation mode is effected by virtue of the spark being alternately supplied from the primary-side supply voltage and the energy stored in the ignition transformer. As a result, the polarity of current and voltage at the spark plug is reversed each time. The burning duration of the spark can be configured virtually freely. Multiple sparks are possible as a result of rapid charging with the available high voltage taking account of the residual energy of the coil. The spark can be actively switched off by reducing the supply voltage below the inverse transformed arc voltage with the IGBT simultaneously switched on. The combination of reduced secondary peak current and change of polarity now makes it possible to maintain the arc for significantly longer without restricting the lifetime of the spark plug. The longer burning duration of the arc very significantly improves the combustion behavior.

Moreover, the chosen embodiment in accordance with one embodiment allows spontaneous reignition if the arc is blown and extinguishes as a result of extremely high turbulences. This in turn very significantly increases the ignition reliability.

It is also possible to generate a plurality of rapidly successive ignition sparks.

Some embodiments may fully utilizes the components of an existing ignition system, wherein the blocking diode in the ignition coil advantageously may be obviated.

Some embodiments may significantly reduce the size of the ignition coil, which may be particularly advantageous for "pencil coils" owing to the confined structural space in the spark plug shaft. Reducing the size of the ignition coil may very significantly reduce the production costs thereof.

Forming the spark energy by means of regulation in the manner disclosed herein allows a substantially freely selectable spark duration and freely selectable spark current profile. At the same time, the energy to be stored in the ignition coil is reduced to a value which still ensures a reliable build-up of the respective maximum breakdown voltage to be expected.

The example ignition device shown in FIG. 1 comprises a controllable supply voltage source DC/DC embodied as a voltage converter for supplying one or a plurality of ignition coils ZS with a variable supply voltage Vsupply. It is supplied from the on board supply system voltage V_bat of currently approximately 12V. It supplies one or a plurality of ignition coils ZS, it being advantageous that a blocking diode is no longer necessary. It is possible to use conventional spark plugs ZK connected to the secondary winding of the ignition coil ZS. The primary winding of the ignition coil ZS is connected in series with a switching element—usually embodied as an IGBT—for switching the ignition coil ZS. Devices for detecting the primary voltage and the primary current and the secondary current are provided.

A control unit SE generates the variable supply voltage Vsupply and the drive signal IGBT_Control for the switching element IGBT depending on the detected operating variables by means of the voltage converter DC/DC.

The control unit SE is in turn controlled by a microcontroller (not illustrated), which predefines the ignition instant for each ignition coil in real time via separate timing inputs. Via a further interface—for instance the conventional SPI (Serial Peripheral Interface)—it is possible to exchange data between the microcontroller and the control unit SE.

The voltage converter DC/DC generates a supply voltage Vsupply from the 12V on-board system supply V_bat. The value of said supply voltage Vsupply is highly dynamically controllable by means of the control signal V_Control at the control input Ctrl of the voltage converter DC/DC in a range of 2 to 30V, for example. In this case, the voltage converter DC/DC can supply the required charging current for the respectively activated ignition coil ZS.

As ignition coil ZS, a conventional type having a turns ratio of e.g. 1:80 can be used, but the blocking diode required in present day conventional coils can be dispensed with. Depending on the number of cylinders of the spark ignition engine used, e.g. 3 to 8 ignition coils are necessary. On account of the method disclosed herein however, it is possible to use an ignition coil having a significantly lower maximum storage energy.

As spark plug ZK, a conventional type can be used. Its exact configuration is determined by the use in the engine.

As switching element IGBT, a conventional type having internal voltage limiting of 400V, for example, can likewise be used. Depending on the required charging current, however, its required current carrying capacity can be reduced.

The signal V_Prim maps the primary voltage—stepped down by means of a voltage divider composed of resistors R1 and R2—of the ignition coil ZS of up to 400V onto a value range of e.g. 5V that can be used for the control unit SE. The value of the voltage division is 1:80 in the example mentioned. The voltage divider R1, R2 is arranged between the connecting point of the primary winding of the ignition coil ZS and the switching element IGBT and the ground terminal 0. The ground terminal 0 is connected to the negative potential GND of the supply voltage Vsupply.

For measuring the current through the primary winding of the ignition coil ZS, a resistor R3 is connected in series with the primary winding and the switching element IGBT. The charging current flowing through the resistor R3 generates a voltage I_Prim representing the current.

In the same way, a resistor R4 is connected in series with the secondary winding of the ignition coil ZS. The secondary current flowing through said resistor R4 generates the voltage I_Sec dropped across the resistor R4.

Figure 2:
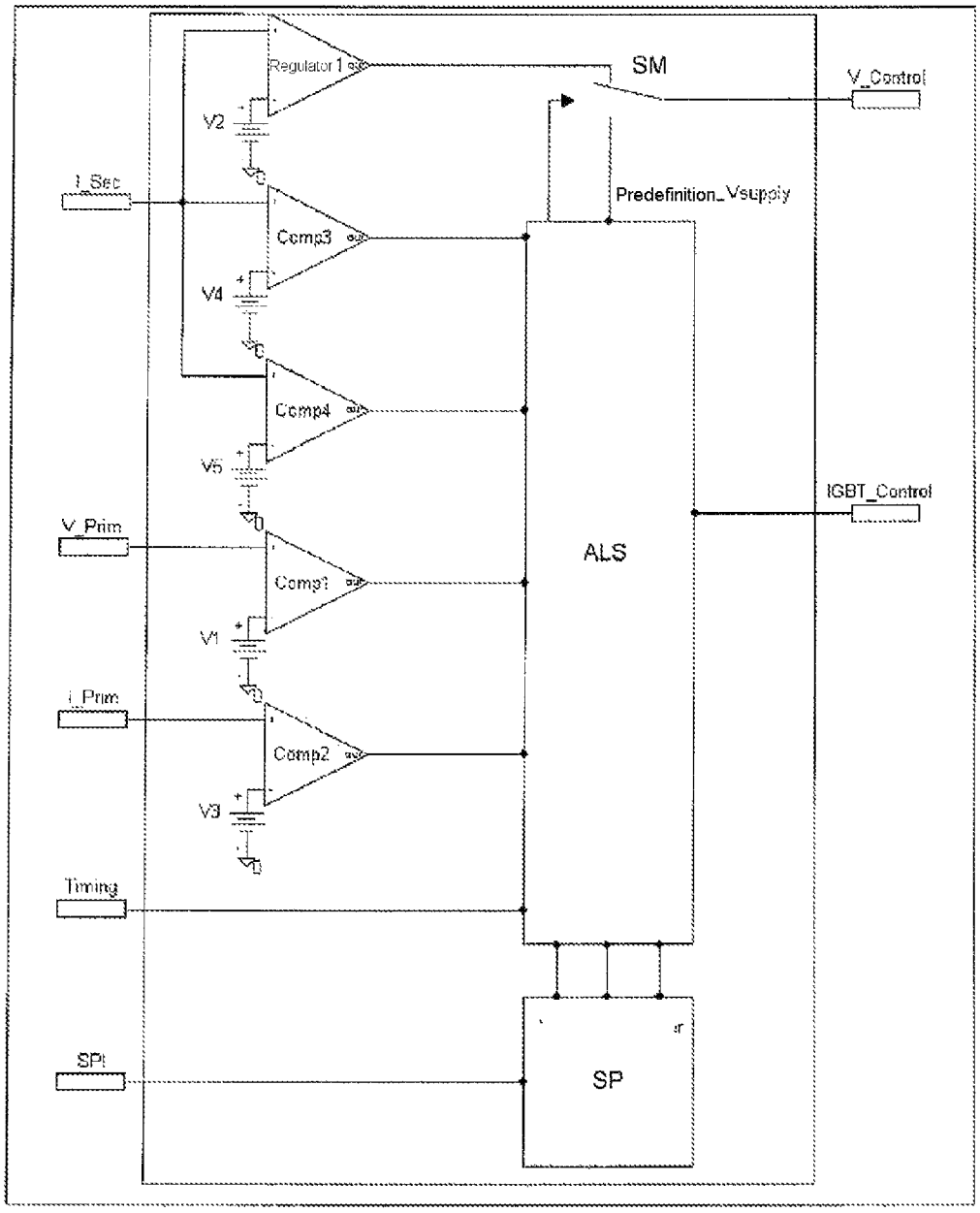
FIG. 2 shows a detailed circuit of a control unit, according to one embodiment.

The control unit SE comprises the voltage converter DC/DC and a control circuit Control. The latter detects the signals V_Prim, I_Prim and I_Sec and compares them by means of voltage comparators Comp1 . . . Comp4 in accordance with FIG. 2 with threshold or desired values V1 . . . V5.

At an instant predefined by the input signal Timing from the microcontroller, the control unit SE triggers an ignition operation, wherein burning duration and arc current are regulated. For this purpose, in some embodiments the supply voltage Vsupply is controlled by means of the control signal V_Control, or the switching element IGBT is switched on and off by means of the drive signal IGBT_Control. The control signal V_Control is present at the output of a switching means SM that can be controlled by the sequence controller ALS, and, depending on the driving, is formed either by a regulator circuit Regulator1 or the sequence controller ALS.

In the case of spark ignition engines having a plurality of cylinders, a plurality of timing inputs and a plurality of IGBT_Control outputs should correspondingly be provided.

Furthermore, the control circuit Control is connected to the microcontroller via an SPI interface. The microcontroller can then transmit predefinitions for charging current, burning duration, burning current; but also predefinitions for the configuration of multiple spark ignition. In the opposite direction, the controller can transmit status and diagnosis information to the microcontroller.

The sequence controller ALS formed in the control circuit Control can be formed either by a microcontroller with software contained therein, or by a hardware sequence controller (state machine)—comprising standard logic components.

The method according to certain embodiments will be explained in greater detail below with reference to FIG. 3. In this case, the method comprises a plurality of successive phases.

1. Charging the Coil Inductance

At the beginning of ignition—as also customary heretofore—the main inductance of the ignition coil ZS is charged. For this purpose, by means of the drive signal IGBT_Control from the control unit SE, the switching element IGBT is switched on at the instant t1. The charging current is detected as signal I_Prim in this case. Since no secondary side blocking diode is used, during the charging operation the supply voltage Vsupply has to be altered temporally such that the voltage induced in this case on the secondary side reliably remains below the instantaneous breakdown voltage. The value thereof is substantially given by the instantaneous combustion chamber pressure, which continuously changes during the compression cycle. What is important in this case is that the charging current value which corresponds to the desired storage energy is attained at the latest at the ignition instant t2. Attaining the charging current value somewhat earlier is unimportant in this case since the current can be kept constant by lowering the supply voltage Vsupply. In this case, the supply voltage Vsupply is regulated to a value given by the internal resistance of the primary winding and the charging current. In addition, the voltage losses at the switching element IGBT and at the current measuring resistor R3 are also taken into account. The value of the energy to be stored can be different during each charging phase—on the basis of the observation of preceding ignition operations or predefined via SPI—and can be adapted accordingly.

2. Breakdown

At the predefined ignition instant t2—as also customary heretofore—the switching element IGBT is switched off by means of the drive signal IGBT_Control. In a manner driven by the collapse of the magnetic field, the primary and secondary voltages of the ignition coil ZS then rise rapidly. In detail, the primary voltage—observable as signal V_Prim—firstly exhibits a very rapid rise until the commencement of the voltage limiting by the switching element IGBT at approximately 400V. The cause of this is the discharge of the primary leakage inductance. Afterward, the primary-side voltage again decreases until it rises once again—then with a sinusoidal voltage profile. This voltage profile stems from the inverse transformed secondary voltage. In this case, the secondary capacitance formed by the secondary winding and the electrodes of the spark plug ZK is charged with a resonant polarity reversal operation from the main inductance and the secondary side leakage inductance of the ignition coil ZS. (The interposed ideal transformer should be taken into account in the consideration.) When the breakdown voltage is attained, the sinusoidal polarity reversal operation is abruptly ended and the primary voltage falls to a value of 10V to 50V. This value is in turn composed of the supply voltage Vsupply and the inverse transformed secondary side arc voltage. These details are not illustrated in FIG. 3.

Figure 3:
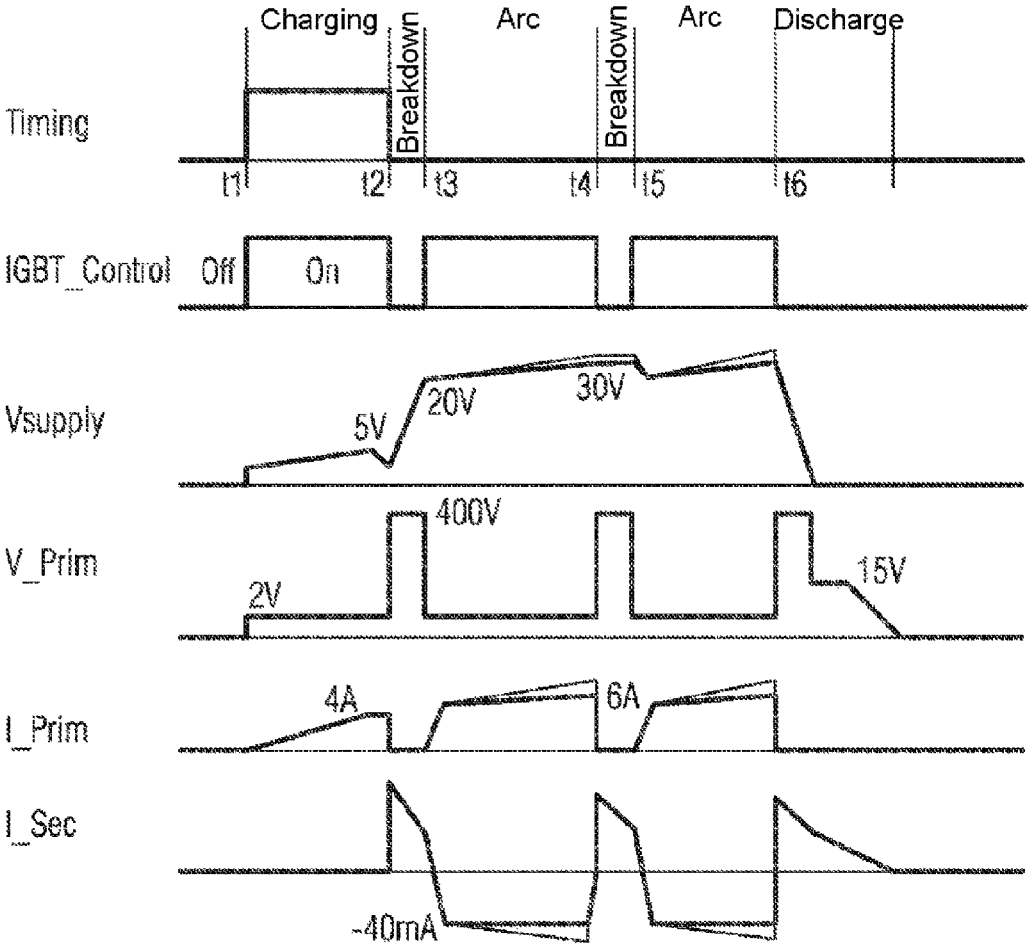
FIG. 3 shows a flow diagram illustrating the temporal relationships, according to one embodiment.

The supply voltage Vsupply is rapidly set to its maximum value of e.g. 30V at the beginning of the breakdown phase by means of the control signal V_Control, this likewise not being discernible in detail in FIG. 3.

3. Burning Phase (arc)

The beginning of the burning phase is identified as soon as the primary voltage falls below a predefined value of e.g. 40V at the instant t3. The signal V_Prim derived therefrom by means of the voltage divider R1, R2 then has a value of e.g. 0.5V and can be compared with a first threshold value V1 by means of a first voltage comparator Comp1. The output of the first voltage comparator Comp1 changes its logic state in the case of the desired value V1 being undershot. This change serves to switch on the switching element IGBT once again at the instant t3. Since the supply voltage Vsupply is now set high again (30V), it is transmitted via the ignition coil ZS on the secondary side as high, negative voltage of e.g. 2.4 kV. Since at this point in time, owing to the arc, there is ionized gas between the electrodes of the spark plug ZK, a renewed breakdown is effected approximately at the arc voltage of approximately 1 kV.

As a consequence of the voltage difference between the burning voltage and the transformed primary voltage, a negative arc current builds up very rapidly. In this case, the rise is substantially determined by the primary and secondary leakage inductances and the voltage drops across the winding resistances. In this case, the arc current is detected by the signal I_Sec by means of the resistor R4.

If the arc current is then intended to be kept constant, it is compared with a first desired value V2 in a regulator circuit Regulator1. The output signal of the regulator circuit Regulator1 is fed to the voltage converter DC/DC as control signal V_Control via the switching means SM, which is correspondingly driven by the sequence controller, and then controls the supply voltage Vsupply in such a fashion that the secondary current I_Sec corresponds to the desired value V2. In this case, the supply voltage Vsupply will initially assume a value of e.g. 20V, which continuously rises as the burning duration progresses.

Since, at the same time as the current transmission to the secondary side, the main inductance of the ignition coil ZS is also charged, the current flow thereof rises continuously. It is detected by way of the signal I_Prim at the resistor R3 and compared with a second desired value V3 by a second voltage comparator Comp2. If the signal I_Prim rises above the second desired value V3 on account of the current rise, then the switching element IGBT is switched off again at the instant t4 by means of the drive signal IGBT_Control.

The supply voltage Vsupply is in turn set rapidly to its maximum value of e.g. 30V by means of the control signal V_Control.

As described under 2. Breakdown, the collapse of the magnetic field then drives the secondary voltage in a positive direction until—at a voltage of approximately +1 kV—a renewed breakdown with subsequent arc phase takes place. This renewed arc phase is then fed by the energy previously stored in the main inductance, the (now positive) secondary side arc current decreasing continuously. Since the renewed breakdown is effected at a significantly lower voltage, in this case significantly less energy is also required for charging the secondary capacitance and the remaining residual energy substantially corresponds to the energy previously stored.

By way of the signal I_Sec, the secondary side arc current is then compared with a third threshold value V4 by means of a third voltage comparator Comp3. If the value of I_Sec falls below the third threshold value V4, then the output state of the third voltage comparator Comp3 changes and the switching element IGBT is switched on once again at the instant t5. As a result, a renewed arc phase with a negative arc current is effected, as described above.

In one embodiment, the first threshold value V1 can be fashioned dynamically, as a result of which a variable burning current profile can be generated. By way of example, as the burning duration increases, the arc current can rise, which increases the reliability of combustion, without adversely influencing spark plug wear.

4. End of the Burning Phase

This cyclic change of negative and positive burning current can be repeated as often as desired and is only ended by the predefined burning duration of e.g. 1 ms. The switching element IGBT is then finally switched off. The energy stored in the ignition coil ZS at this instant t6 still dissipates in the arc, whereupon the latter extinguishes. The ignition operation is ended.

5. Reignition in the case of Misfires

During the burning phase, the arc can extinguish, e.g. in a manner caused by blowing owing to increased turbulences in the electrode region or as a result of the electrodes being wetted with fuel droplets. If this occurs in an arc phase with the switching element IGBT switched on, then the secondary current spontaneously falls to zero and can be identified by observing the signal I_Sec. For this purpose, the signal I_Sec is compared with a fourth threshold value V5 by a fourth voltage comparator Comp4 and, in the case of the signal I_Sec exceeding said threshold value V5, the switching element IGBT is switched off, whereupon a renewed breakdown is effected. The above described sequence of the arc phase is subsequently effected.

If this occurs during the discharge phase of the main inductance with the switching element IGBT switched off, then this drives the secondary voltage until a renewed breakdown takes place. If the arc current falls below the third threshold value V4 owing to the energy loss, then the switching element IGBT is once again switched on and the sequence of the arc phase commences anew—as described above.

It is thus ensured that immediate reignition takes place in the case where the arc is extinguished. With high probability, misfires no longer take place.

6. Multiple Spark Ignition

The sequence of multiple ignition substantially corresponds to the operating phases described above. In contrast thereto, however, the burning phase is greatly shortened, approximately 0.1 ms in comparison with usually 0.5 ms to 1.5 ms. However, the ignition operation is repeated a number of times in rapid succession.

After charging has taken place and flashover has taken place, the following burning phase (with switching element IGBT switched on) is interrupted at the desired point in time by lowering the supply voltage Vsupply. The latter is in this case lowered rapidly to a value which is necessary for maintaining the charging current and is reliably below the inverse transformed burning voltage of the arc. The spark therefore extinguishes spontaneously and the coil remains charged. At the predefined instant, the switching element IGBT is then switched off again and a renewed breakdown with subsequent arc phase is effected. This operation can then be repeated a number of times in accordance with the presetting.

The method and ignition device described here completely fulfill all of the requirements made initially. Owing to the continued use of the conventional ignition components and the additional electronics kept comparatively simple, only low additional costs arise, which are certainly offset by the reduction in the size of the ignition coils that is now possible. The method disclosed herein may be particularly advantageous in difficult combustion situations such as, for instance, during the cold start of engines operated with ethanol.

What is claimed is:

1. A method for operating an ignition device for an internal combustion engine, which ignition device comprises an ignition coil embodied as a transformer, a spark plug connected to a secondary winding of the ignition coil, a drivable switching element connected in series with a primary winding of the ignition coil, and a control unit connected to the primary winding of the ignition coil and a control input of the switching element, wherein the control unit is configured to provide an adjustable supply voltage for the ignition coil and a drive signal for the switching element depending on currents through the primary and secondary windings of the ignition coil and a voltage between a connecting point of the primary winding of the ignition coil to the switching elemeht and a negative terminal of the supply voltage, the method comprising:

in a first phase, the switching element is switched by the drive signal to be conducting at a first switch-on instant and to be non-conducting again at the predefined ignition instant, in a subsequent second phase, the primary voltage or a voltage derived therefrom is compared with a first threshold value and, in the case of said voltage falling below the first threshold value, the switching element is switched to be conducting again at a second switch-on instant, in a subsequent third phase, the supply voltage is regulated such that the current through the secondary winding of the ignition coil approximately corresponds to a predefined current and the current through the primary winding of the ignition coil is compared with a predefined second threshold value and, in the case of said current exceeding the second threshold value, the switching element is switched to be non-conducting again at a first switch-off instant, in a subsequent fourth phase, the current through the secondary winding of the ignition coil is compared with a third threshold value and, in the case of said current falling below the third threshold value, the switching element is switched to be conducting again at a third switch-on instant, subsequently the third and fourth phases are repeated until a predefined burning duration is reached at an instant, at which point the switching element is finally switched to be non-conducting.

2. The method of claim 1, wherein the supply voltage is set to a maximum value with the switching element being switched to be non-conducting.

3. The method of claim 1, wherein the current predefined in the third phase is variable.

4. The method of claim 1, wherein during the phases in which the switching element is switched to be conducting, the current through the secondary winding is compared with a fourth threshold value and the switching element is switched to be non-conducting if the fourth threshold value is exceeded by said current, and in that afterward the primary voltage or a voltage derived therefrom is compared with the first threshold value and, in the case of said voltage falling below the first threshold value, the switching element is switched to be conducting again.

5. An ignition device for an internal combustion engine, comprising:

an ignition coil embodied as a transformer and including a secondary winding configured for connection to a spark plug, a drivable switching element connected in series with a primary winding of the ignition coil, and a control unit connected to the primary winding of the ignition coil and a control input of the switching element, wherein the control unit comprises a controllable voltage converter that provides at an output a supply voltage for the ignition coil, said supply voltage being adjustable depending on a control signal present at a control input of said voltage converter, and is configured for connection to a motor vehicle on-board supply system voltage, and wherein the control unit further comprises a control circuit that provides the control signal for the voltage converter and a drive signal for the switching element depending on currents through the primary and secondary windings of the ignition coil and a voltage between a connecting point of the primary winding to the switching element and a negative terminal of the supply voltage.

6. The ignition device as claimed in claim 5, wherein the control circuit has comprises voltage comparators comprising:

reference inputs that receive reference signals can be applied, and comparison inputs that receive signals representing the current through the primary winding of the ignition coil and the current through the secondary winding of the ignition coil and the voltage derived from the voltage between the connecting point of the primary winding to the switching element and the negative terminal of the supply voltage, and outputs connected to inputs of a sequence controller, including:

a first output connected to the control input of the switching element and a second output connected, via a switching means that can be changed over by the sequence controller, to the control input of the voltage converter, and wherein the control circuit comprises a regulator circuit including:

a reference input that receives a reference signal representing a desired value, a comparison input that receives the signal representing the current through the secondary winding of the ignition coil and, an output connected, via the switching means in a switched state, to the control input of the voltage converter.

* * * * *